US007017708B1

(12) United States Patent
Lynn

(10) Patent No.: US 7,017,708 B1
(45) Date of Patent: Mar. 28, 2006

(54) RECESSED STEP

(76) Inventor: Darla Lynn, P.O. Box 421, Georgetown, CA (US) 95634

( * ) Notice: Subject to any disclaimer, the term of this patent is extended or adjusted under 35 U.S.C. 154(b) by 105 days.

(21) Appl. No.: 10/796,919

(22) Filed: Mar. 10, 2004

(51) Int. Cl.
*E06C 1/00* (2006.01)
*E06C 9/00* (2006.01)
*A47C 7/62* (2006.01)
*A47B 83/00* (2006.01)

(52) U.S. Cl. ..... 182/35; 182/88; 297/188.09; 297/188.1; 297/423.39; 312/235.1

(58) Field of Classification Search ..... 182/35, 182/91, 88, 20, 230, 129; 297/188.08, 188.09, 297/188.1, 423.14, 423.39, 423.41; 312/235.1, 312/235.2, 235.3, 235.5, 278, 228, 330.1, 312/334.1
See application file for complete search history.

(56) References Cited

U.S. PATENT DOCUMENTS 2,592,912 A * 4/1952 Knipper ..... 182/35
3,136,386 A 6/1964 Horvath
3,311,190 A * 3/1967 Naumann ..... 312/235.3
3,481,429 A 12/1969 Gaede
4,846,304 A 7/1989 Rasmussen
4,924,970 A * 5/1990 Seals et al. ..... 182/91
5,005,667 A * 4/1991 Anderson ..... 182/35
5,009,282 A * 4/1991 Willsher ..... 182/88
D323,537 S 1/1992 Wilkinson
5,085,290 A 2/1992 Guirlinger
5,131,492 A 7/1992 Caminiti
5,641,034 A * 6/1997 Calmeise et al. ..... 182/33
5,967,255 A 10/1999 Young
6,425,457 B1 * 7/2002 Lundry ..... 182/35
6,439,342 B1 * 8/2002 Boykin ..... 182/88

* cited by examiner

*Primary Examiner*—Hugh B. Thompson, II
(74) *Attorney, Agent, or Firm*—Lawrence J. Gibney, Jr.

(57) ABSTRACT

This device will allow the user access to a platform and also use the device as an additional step. It will be easy to move and easy to stow. Unlike a footstool it can be easily stowed under cabinets or chairs. A hole in the center section, which is the step, allows the user to easily move it from location to location. Hinges on the sides of the steps allow the step to be raised and lowered at will and a stop mechanism is provided to allow the step to be raised and stay in position.

6 Claims, 3 Drawing Sheets

RECESSED STEP

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

1. Field of the Invention

This is a device, which will allow the user to "add" a step in needed situations such as hard to reach places in the kitchen, or closets. The step is portable and easily stowed when not in use.

2. Prior Art

The prior art in this area reveals that there are a variety of means to add a step in certain applications. These can be attached to cabinets such as Caminiti, U.S. Pat. No. 5,131,492 or drawers as in Gaede, U.S. Pat. No. 3,481,429. Additionally, there are fold away steps, Horvath, U.S. Pat. No. 3,136,386.

While these are indeed similar ideas, they are permanently attached or affixed to an object.

This device is a portable additional step, which can be moved from location to location and provides the user with greater flexibility in terms of ease of access and utility.

BRIEF SUMMARY OF THE INVENTION

One of the difficulties in the home or business is reaching overhead areas. People stand on chairs, footstools and the like to reach these difficult areas.

This device combines the utility of a step with portability so that the device will not clutter up the home or be a traffic hazard in a kitchen or garage.

The device will provide another step, which will raise to a level of approximately six to eight inches above the level of the rest of the device. The additional step is raised by use of a hinge mechanism, which has been placed on the outside edges of the step. This is not a step stool because it can be stored under a cabinet or in its own storage place and hidden from view.

It is a portable unit that allows the user to have within his or her grasp a device, which will add an additional step wherever one may be needed. The device is in the shape of a hollow, rectangular box. In the approximate middle of the device is a piece of wood with a hole in the middle. This piece of wood rotates up and down and provides the additional step.

The hole in the center of the piece allows the owner to carry the device from location to location with relative ease. The step—when in the down position—will remain flush with the rest of the unit and can be used as a platform. The device when used as a platform is raised off the ground approximately six to eight inches. The step is raised and lowered by two sets of hinges, which are connected to the step and to one side of the rectangular box.

DETAILED DESCRIPTION OF THE EMBODIMENT

Figure 1:
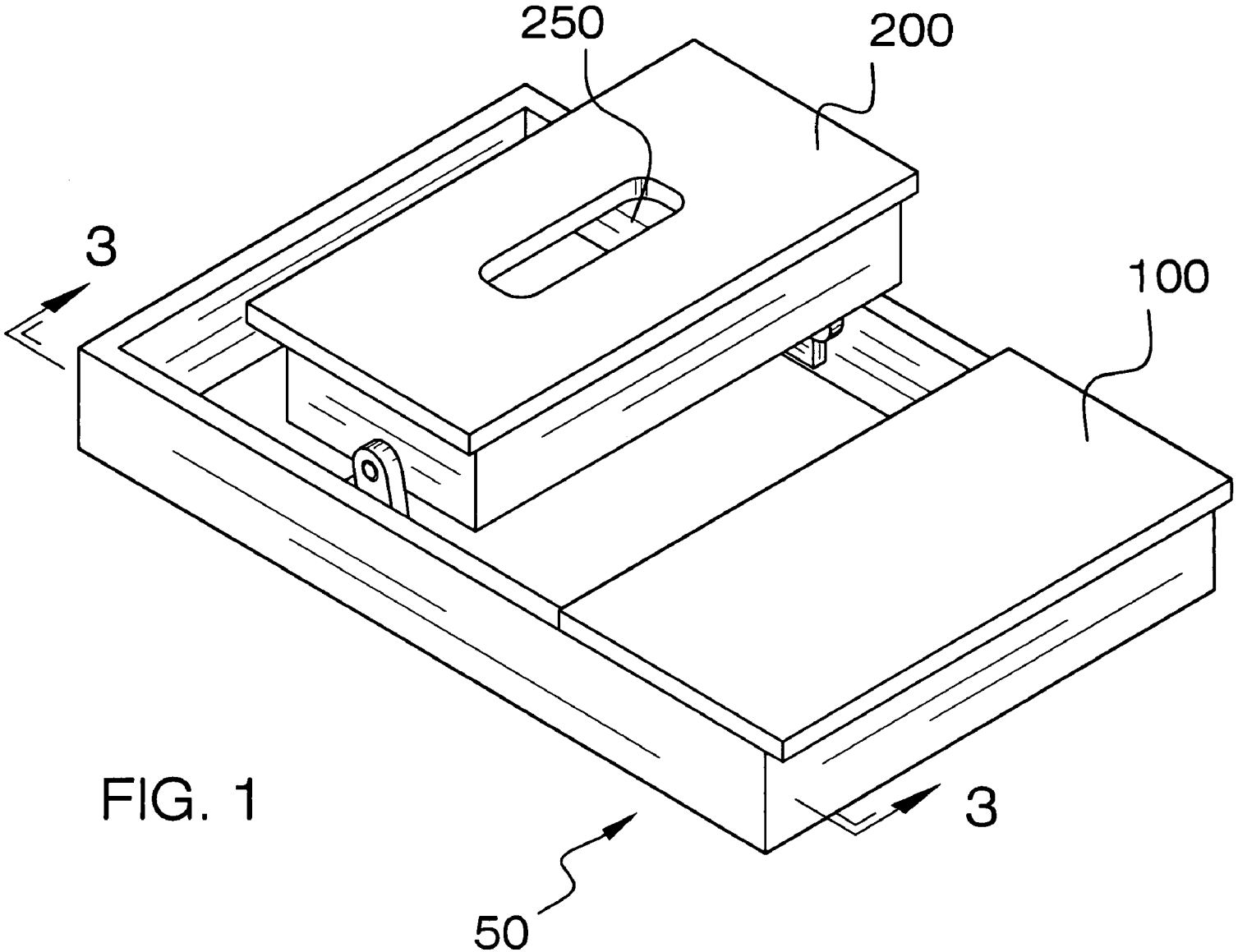
FIG. 1 is a perspective view of the device with the added step in the raised position.

This particular device 50 is in the shape of a rectangular box or frame. The device is comprised of a flat planar surface 100 with a step 200 which can be raised and lowered approximately six to eight inches. FIG. 1 shows the perspective view of the device with the step 200 in the "up" or raised position. On one end of the rectangular box is the flat surface 100, which is permanently affixed to approximately one third of a portion of the top of the rectangular box. The flat surface 100 allows the person to step on the device 50 and then step on the additional step 200, which is provided.

Figure 3:
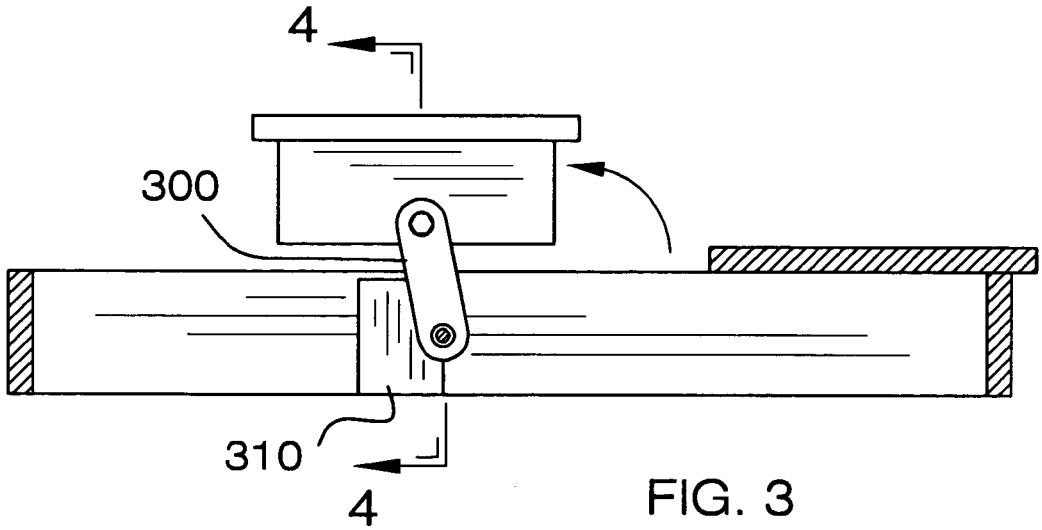
FIG. 3 is a cross sectional view of the device showing the step in the raised position.
Figure 4:
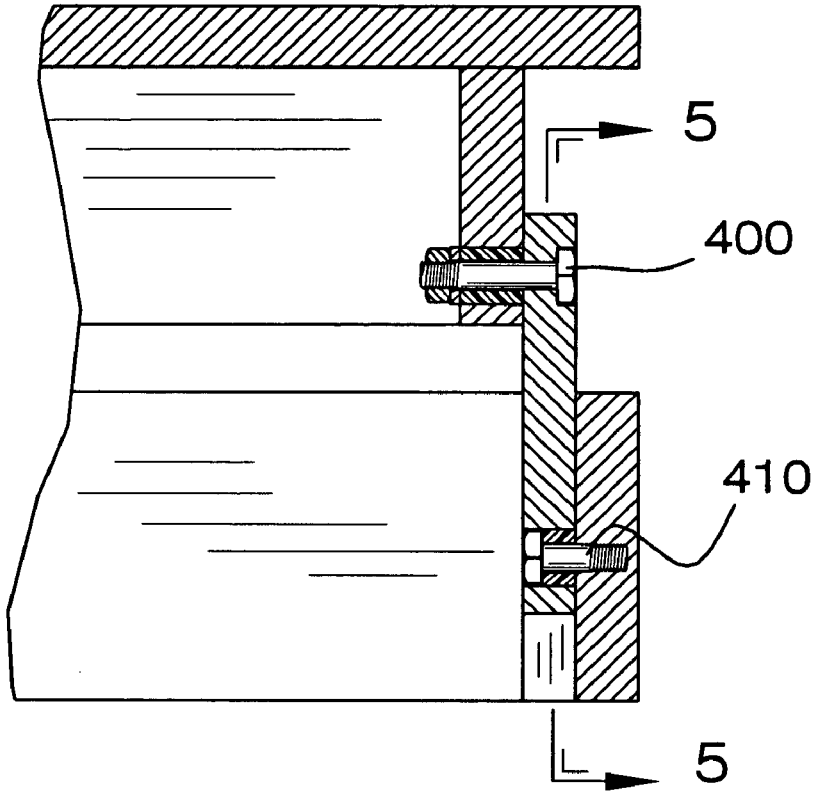
FIG. 4 is a cross sectional view of the mechanism to support the step.

In the center of the device is the recessed step 200, which rotates around a nut and bolt assembly, 400, 410, on both sides of the bottom surface of the recessed step 200. FIG. 4 The nut and bolt assembly 400, 410 are attached to the device with hinges 300 on both sides of the step. FIG. 3 The device will give the person an additional six to eight inches when the step, 200 is in the "up" position.

Figure 2:
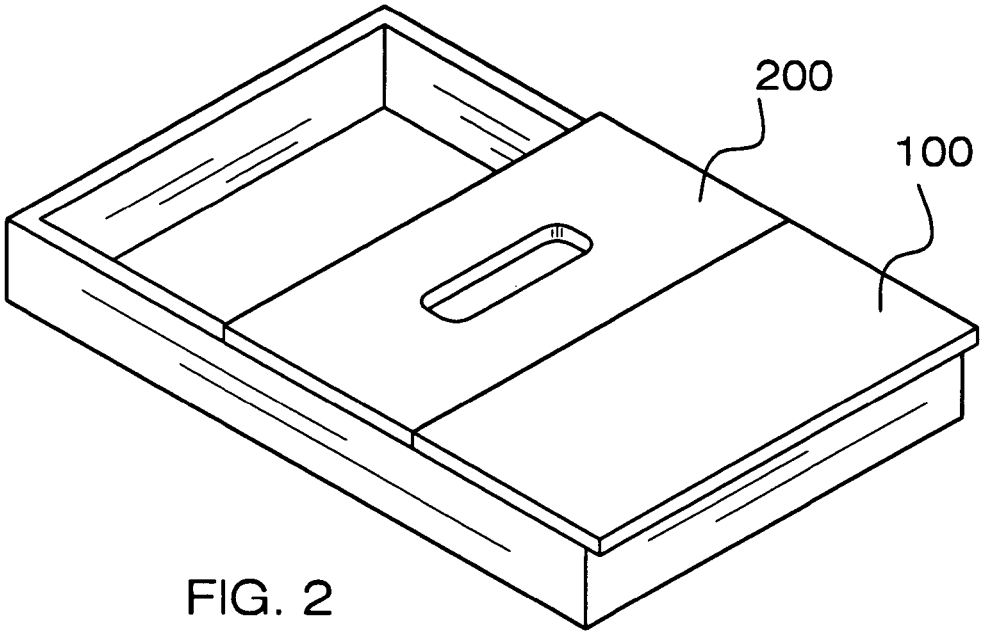
FIG. 2 is a perspective view of the device with the added step flush with the top of the device.

In the "down" position the recessed step 200 lies flush and parallel with the flat planar surface 100. FIG. 2 This allows easy storage of the device 50.

A hole 250 in the middle of the recessed step 200, which is raised or lowered, allows the user to carry the device from place to place and stow it wherever desired. When the step 200 is "down" the device 50 can be slid under a couch or stowed between appliances. This keeps the device 50 out of the way of the homeowner. FIG. 2 shows the step in the "down" position.

FIG. 2 is s perspective view showing the position of the step 200 and the other flat planar member 100 lying flush with the step 200. The recessed step 200 will rotate in an "up" or "down" direction and is supported by a hinge 300 and a stop mechanism 310 on both sides of the step. FIG. 3 The hinge 300 and stop mechanism 310 allows the additional step 200 to be raised and lowered to the desired height. Hinges 300 are located on both sides of the recessed steps to secure the step to the device.

Figure 5:
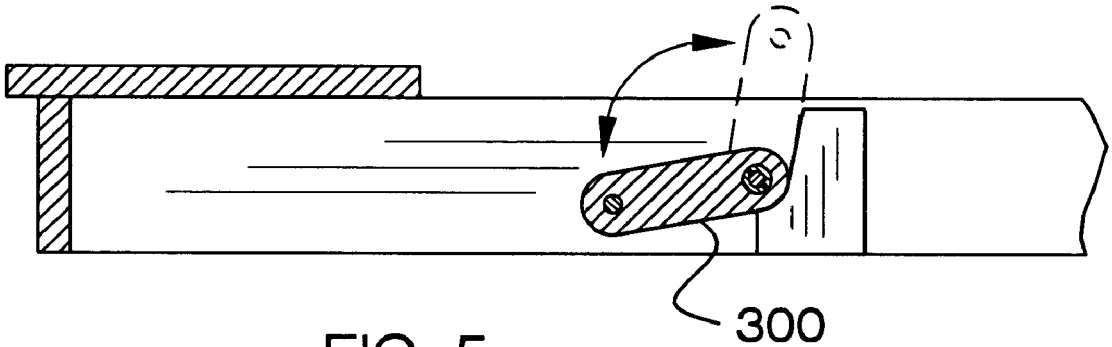
FIG. 5 is a view showing the articulation of the hinge.

The hinge 300 as depicted in FIG. 3 is supported by a bolt and nut assembly 400, 410, which is connected to the step 200 and the wooden frame of the device 50. FIG. 4 The hinges 300 are located at the approximate midpoint of the recessed step 200 and the side member of the rectangular box. While a nut and bolt assembly 400, 410 is depicted in FIG. 3, other means of attachment may be used to achieve the same purpose. The nut and bolt assembly 400, 410 as depicted in FIG. 5 is recessed slightly to allow freedom of movement of the step 200 from the up to down position and vice versa.

The stop mechanisms 310 are positioned so that the step 200 rotates to a position slightly greater than ninety degrees from the vertical plane. This angle will insure that the step 200 stays in place as it rotates upward to approximately one hundred and ten degrees from the vertical plane of the device. The degree of rotation of the step 200 in relation to the horizontal plane allows the step to be raised and stay in an upright position without the necessity of a separate hinge or other locking device.

The step 200 is prevented from rotating more than approximately one hundred and ten degree by the stop mechanism 310, which has been placed adjacent to the hinge 300. FIG. 3 The stop mechanism 310 is positioned on the inner surface of the device and will prevent the step from rotating any more than approximately one hundred and ten degrees. Both inner surfaces of the device are equipped with the stop mechanism 310 at the location of the step 200.

The choice of material will be selected so that the device will be able to support an adult and be durable for that purpose.

The invention claimed is:

1. A device for adding a step in one device, which comprises the following:

two long sides of predetermined dimensions;

two short sides of predetermined dimensions;

a flat planar member;

a step;

hinges; and a stop mechanism;

wherein the two long sides are identical;

wherein the two short sides are identical;

wherein the two long sides and two short sides when assembled form a base;

wherein the base does not have a bottom surface;

wherein the sides form a support for the flat planar member and the step;

wherein the flat planar member is supported by the sides of the device;

wherein the flat planar member is stationary;

wherein the flat planar member is secured to the top surface of the base;

wherein a means to secure the flat planar member to the top surface of the base is provided;

wherein the step is secured to the long sides of the base;

wherein a means to secure the step to the base is provided;

wherein hinges are secured to the mid section of the step and to the mid section of the sides of the device;

wherein the step is allowed to rotate and be elevated off the top surface of the base from an up position to a down position;

wherein the stop mechanism prevents over-rotation of the step and is permanently affixed to an inner surface of the device;

wherein when the step is in the down position it will be flush with the flat planar member;

wherein a hole of predetermined size is cut out in the step to raise and lower the step and carry the device.

2. The device as described in claim 1, wherein the flat planar member is permanently affixed to the top surface of the base by screws.

3. The device as described in claim 1, wherein the step can be raised to approximately six to eight inches above the flat planar member.

4. The device as described in claim 1, wherein the hinges are supported by a nut and bolt assembly.

5. The device as described in claim 1, wherein the hinges allow rotation of the step.

6. The device as described in claim 1, wherein hinges are provided on both sides of the step.

* * * * *